United States Patent [19]

Nakazawa

[11] 4,384,790

[45] May 24, 1983

[54] ALARM DEVICE FOR ELECTRONIC WATCHES

[75] Inventor: Eiji Nakazawa, Akishima, Japan

[73] Assignee: Casio Computer Co., Ltd., Tokyo, Japan

[21] Appl. No.: 290,377

[22] Filed: Aug. 5, 1981

Related U.S. Application Data

[63] Continuation of Ser. No. 96,239, Nov. 20, 1979, Pat. No. 4,322,830.

[30] Foreign Application Priority Data

Nov. 25, 1978 [JP] Japan ..... 53-145779

[51] Int. Cl.[3] ..... G04B 19/24; G04B 23/02

[52] U.S. Cl. ..... 368/29; 368/73; 368/67

[58] Field of Search ..... 368/28–30, 368/34, 67, 72–74, 250, 251, 155, 157, 252, 227, 82–84, 239–242

[56] References Cited

U.S. PATENT DOCUMENTS

| | | | |
|---|---|---|---|
| 3,813,533 | 5/1974 | Cone | 368/10 |
| 3,999,050 | 12/1976 | Pitroda | 368/10 |
| 4,005,571 | 2/1977 | Wolff | 368/108 |
| 4,093,992 | 6/1978 | Kawamura et al. | 368/155 |
| 4,104,865 | 8/1978 | Sasaki | 368/28 |
| 4,150,535 | 4/1979 | Morokawa et al. | 368/156 |
| 4,162,610 | 7/1979 | Levine | 368/28 |

FOREIGN PATENT DOCUMENTS

| | | |
|---|---|---|
| 2333116 | 1/1975 | Fed. Rep. of Germany . |
| 2507692 | 9/1976 | Fed. Rep. of Germany . |
| 2628092 | 1/1977 | Fed. Rep. of Germany . |
| 2643938 | 3/1977 | Fed. Rep. of Germany . |
| 2643993 | 4/1977 | Fed. Rep. of Germany . |
| 2553417 | 6/1977 | Fed. Rep. of Germany . |
| 832476 | 4/1960 | United Kingdom . |
| 1518436 | 7/1978 | United Kingdom . |
| 1537102 | 12/1978 | United Kingdom . |
| 2012076 | 7/1979 | United Kingdom . |

*Primary Examiner*—Vit W. Miska

*Attorney, Agent, or Firm*—Frishauf, Holtz, Goodman & Woodward

[57] ABSTRACT

An alarm device for electronic watches has a memory for storing data representing a specified date. When the user operates a switch on that day, the device sounds an alarm to tell the user the specified date has arrived.

5 Claims, 5 Drawing Figures

ALARM DEVICE FOR ELECTRONIC WATCHES

This is a continuation, of application Ser. No. 96,239 filed Nov. 20, 1979, now U.S. Pat. No. 4,322,830, issued Mar. 30, 1982.

BACKGROUND OF THE INVENTION

This invention relates to an electronic timepiece, which is provided with a memory for storing data representing a specific date and an alarm for sounding an alarm when a switch is operated on that day.

Recently an attempt has been made to provide an electronic timepiece (hereinafter referred to simply as a watch) with various functions, such as a stopwatch function, an alarm function and a world time display. One of such functions is the so-called "calendar alarm", i.e. to sound an alarm at midnight of a specified day. The user, who is sleeping at midnight in most cases, fails to notice the alarm or is not sure if an alarm has been given forth if he is awakened some minutes later. Another method of showing that a specified day has arrived is known. That is, a display element of the watch flashes or blinks at midnight of the specified day. This method does not work well, either, because the user, who is sleeping, cannot notice the display.

Accordingly, an object of this invention is to provide an alarm device for electronic watches, which sounds an alarm when a switch is operated on a specified day, thus unfailingly telling the user that the specified day has arrived.

SUMMARY OF THE INVENTION

An electronic timepiece according to this invention comprises day counting means for counting reference signals so as to obtain at least date data; memory means for storing data representing a specified date; detecting means for detecting that the date data coincide with the data stored in the memory means; and switch means for causing an alarm unit to sound an alarm when it is operated as long as the date data coincide with the data stored in the memory means.

Constructed as mentioned above, the alarm device of this invention can sound an alarm when the user operates the switch at any time during 24 hours of the specified day, thus telling the user that the specified day has arrived.

BRIEF DESCRIPTION

Figure 3A:
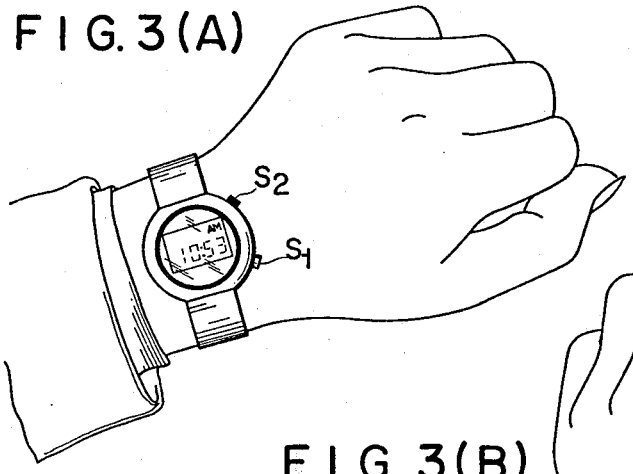
Figure 3B:
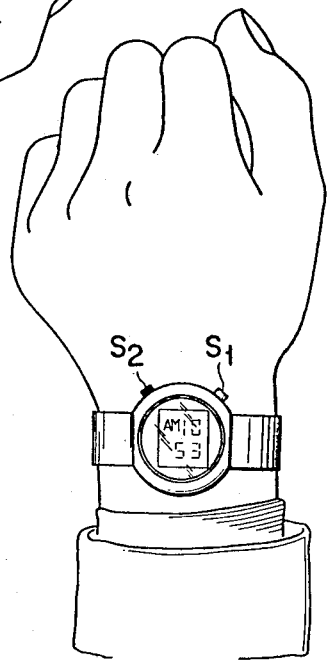
Figure 4:
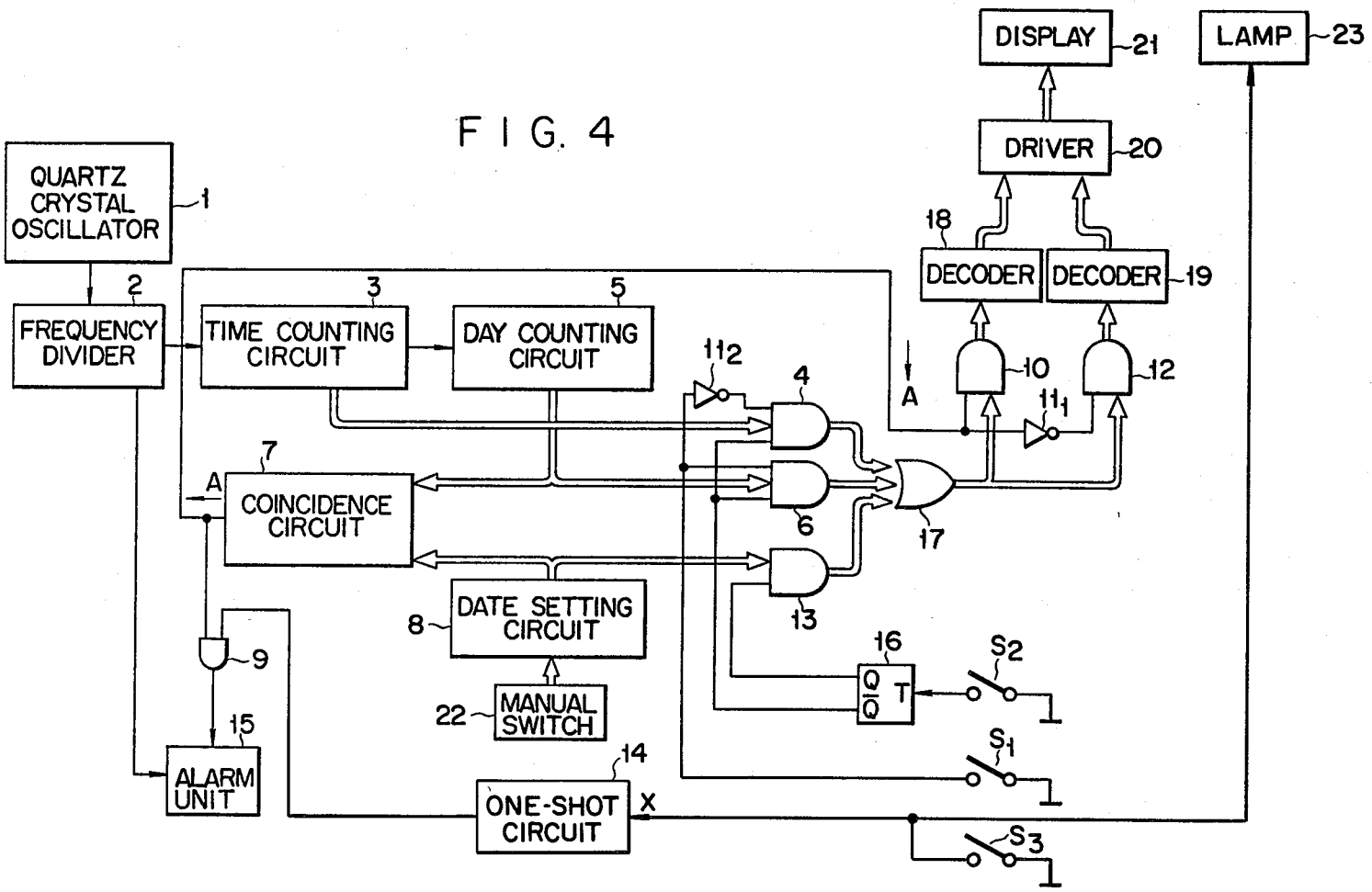

FIGS. 3(A) and 3(B) show a wrist watch in which an alarm device of this invention is incorporated; and FIG. 4 is a circuit diagram showing another embodiment of this invention.

DETAILED DESCRIPTION

Figure 1:
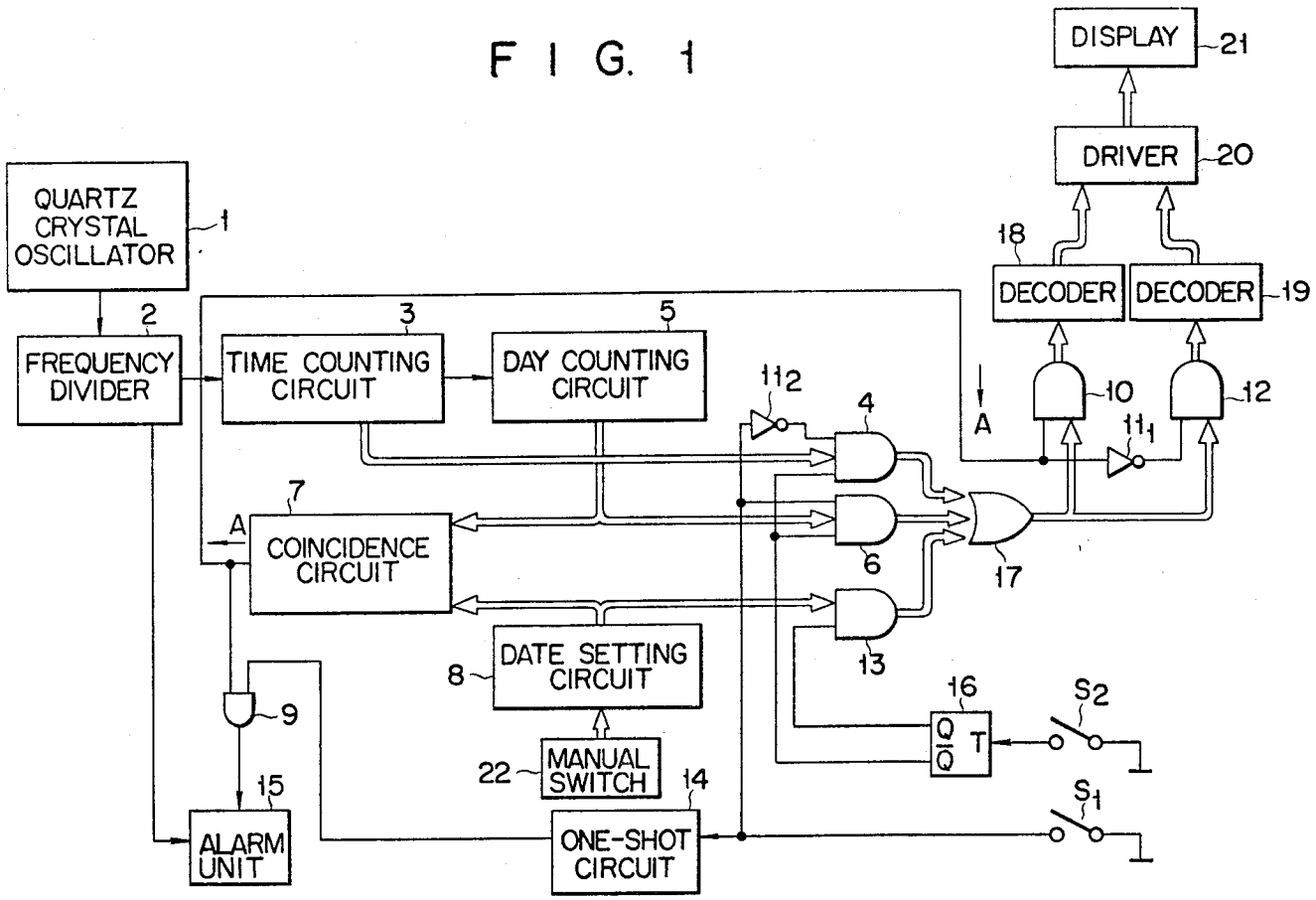
FIG. 1 is a circuit diagram of an electronic watch provided with an embodiment of this invention.

As shown in FIG. 1, pulse signals generated by a quartz crystal oscillator 1 are supplied to a frequency divider 2. The output signals of the divider 2, i.e. reference signals, are counted by a time counting circuit 3. The output data of the circuit 3, which represent the current time, i.e. hour and minute, are supplied to an AND gate 4. Every time it counts 24 hours, the circuit 3 produces a carry signal, which is supplied to a day counting circuit 5. The circuit 5 counts carry signals to obtain data which represent the current date, i.e. month and day. The date data are supplied to an AND gate 6 and a coincidence circuit 7. From a date setting circuit 8 the coincidence circuit 7 receives data which represent a specified date and compares the date data from the circuit 5 with the date data from the circuit 8. As long as the date data from the circuit 5 remain identical with the data from the circuit 8, the coincidence circuit 7 keeps supplying a coincidence signal A to an AND gate 9, an AND gate 10, and an AND gate 12 via an inverter $\mathbf{11}_1$. The data stored in the date setting circuit 8 are supplied also to an AND gate 13.

A switch $S_1$ is operated so as to display either the data from the time counting circuit 3 or the date data from the day counting circuit 5. An output signal of the switch $S_1$ is supplied directly to the AND gate 4 through an inverter $\mathbf{11}_2$. Further, the output signal of the switch $S_1$ is supplied to a one-shot circuit 14, which generates a one-shot signal. The one-shot signal is supplied to an alarm unit 15 through the AND gate 9. The alarm unit 15 receives signals of a predetermined frequency from the frequency divider 2. Upon receipt of a one-shot signal, the alarm gives forth an alarm based on the signals supplied from the frequency divider 2.

Further provided is a switch $S_2$ which is operated so as to display the date set in the date setting circuit 8. When it is operated, the switch $S_2$ generates an output signal. The output signal of the switch $S_2$ is supplied to an input terminal T of a binary flip-flop 16 the Q output of the binary flip-flop 16 is connected to the AND gate 13, and the Q output thereof to the AND gates 4 and 6.

The output data of the AND gates 4, 6 and 13 are supplied to the AND gates 10 and 12 through an OR gate 17. Output data of the AND gates 10 and 12 are decoded by decoders 18 and 19, respectively, are supplied to a display 21 via a driver 20, and are displayed by the display 21.

Figure 2:
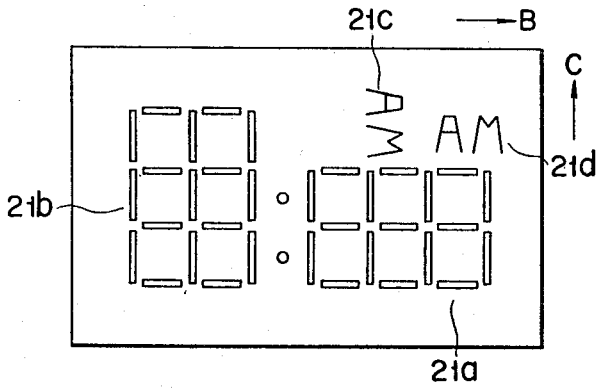
FIG. 2 shows how the display segments of a display used in the watch of FIG. 1 are arranged.

The display 21 may be a liquid crystal display having a plurality of segment electrodes which are arranged as shown in FIG. 2. The display 21 has digital display sections 21*a*, 21*b*, 21*c* and 21*d*. The display sections 21*a* and 21*b* cooperate to display the time, i.e. hour, minute and second and the date, i.e. month and day. The display sections 21*c* and 21*d* display each "AM" or "PM". To display the data from the decoder 18, the display section 21*c* displays "AM" or "PM", and the display sections 21*a* and 21*b* display numerals which stand in the direction of arrow B. To display the data from the decoder 19, the display section 21*d* displays "AM" or "PM", and the display sections 21*a* and 21*b* display numerals which stand in the direction of arrow C.

Unless the switch $S_1$ is depressed, the time data (i.e. hour and minute) from the time counting circuit 3 are supplied to the decoder 19 through the AND gate 4, the OR gate 17 and the AND gate 12. As a result, the display 21 displays the time as illustrated in FIG. 3(A). As long as the switch $S_1$ is pushed, the AND gate 6 remains open, and the AND gate 4 remains closed. The date data are therefore supplied from the day counting circuit 5 to the decoder 19 through the AND gate 6, the OR gate 17 and the AND gate 12. As a result, the display 21 displays the date (i.e. month and day) in place of the time as long as the switch $S_1$ is depressed.

The date setting circuit 8 can store a specified date. To store a new date into the circuit 8 in place of the previously stored date, the switch $S_2$ is operated. As long as the switch $S_2$ is pushed, the binary flip-flop 16 generates Q outputs, whereby the date data stored in the circuit 8 are transferred via the AND gate 13 to the display 21. When the user sees and recognizes the date displayed on the display 21, he operates a manual switch 22 so as to erase the data stored in the circuit 8 and to write new date data into the circuit 8. After the new date data have been stored into the circuit 8, the switch $S_2$ is depressed thereby to start the time display again at the display 21.

As long as the date data obtained by the day counting circuit 5 coincide with the date data stored in the date setting circuit 8, the coincidence circuit 7 produces a coincidence signal A. As a result, the output data of the OR gate 17 are supplied to the decoder 18 through the AND gate 10, and at the same time the output data of the AND gate 12 are prohibited. The time is therefore displayed by the display 21 as illustrated in FIG. 3(B), with numerals standing in the direction of arrow B in FIG. 2. This change of display mode shows the user that the specified day has arrived. When the switch $S_1$ is pushed while the time is displayed in this specific mode, the one-shot circuit 14 supplies a one-shot signal to the alarm unit 15 via the AND gate 9. The alarm unit 15 therefore sounds an alarm for the duration of the one-shot signal, thus showing the user that the specified day has arrived.

In the above-described embodiment the date data from the day counting circuit 5 are compared with the date data stored in the date setting circuit 8 with respect to the month and the day of the month. Instead, they may be compared with respect to only the day of the month or only the day of the week.

In the above-described embodiment the switch $S_1$ is operated to cause the alarm unit 15 to sound an alarm. Instead of the switch $S_1$ which changes the display mode on the specified day, any other switch may be used to perform the same function, such as a switch for turning on a lamp to illuminate a liquid crystal display.

Such a lamp switch ($S_3$) for turning on a lamp to illuminate a liquid crystal display is shown in FIG. 4. The reference numerals used in FIG. 1 are used for corresponding elements in FIG. 4, and a detailed description of these elements is therefore omitted. In FIG. 4, the output of the lamp switch $S_3$ is supplied to the one-shot circuit 14. This output of the lamp switch $S_3$ is also supplied to a lamp 23 which is provided near a display 21. When the lamp switch $S_3$ is actuated on a specified date, the lamp 23 is turned on to illuminate the display 21 and the output of the one-shot circuit 14 is supplied to an alarm unit 15. The alarm unit 15 then generates an alarm sound.

Further, the alarm unit 15 may sound an alarm for a period of time during which the switch $S_1$ is depressed, not for the duration of the one-shot signal. The alarm unit 15 may give forth a melodious sound, a buzzing sound, a bell sound or a chime sound.

What is claimed is:

1. An electronic timepiece having an alarm unit and means for generating periodic reference signals, comprising:

time counting means for counting said reference signals to generate time data, including a per day signal;

display means coupled to said time counting means for displaying the time data generated by said time counting means;

manually operable switch means coupled to said display means and adapted to be manually operated for switching display data different from the time data on said display means;

date counting means coupled to said time counting means for counting the per day signals which are generated by said time counting means to generate at least date data;

memory means for storing desired date data;

coincidence detection means coupled to said memory means and to said date counting means for detecting coincidence between the desired date data stored in said memory means and the date data generated by said date counting means and for producing a coincidence signal during an alarm day on which both the desired date data and the generated date data coincide; and an alarm device coupled to said manually operable switch means and to said coincidence detection means for generating an alarm sound responsive to said coincidence signal and to operation of said manually operable switch means for displaying data different from the time data, on said display means, on said alarm day on which said coincidence detection means produces said coincidence signal.

2. An electronic timepiece according to claim 1, in which said data different from said time data is date data generated by said date counting means.

3. An electronic timepiece according to claim 1, in which said alarm sound is a melody sound.

4. An electronic timepiece having an alarm unit and mans for generating reference signals, comprising:

time counting means for counting said reference signals to generate time data, including a per day signal;

display means coupled to said time counting means for displaying the time data generated by said time counting means;

lamp means for illuminating said display means, thereby making data visible on said display means;

manually operable switch means coupled to said lamp means for supplying power to said lamp means;

date counting means coupled to said time counting means for counting the per day signals which are generated by said time counting means to generate at least date data;

memory means for storing desired date data;

coincidence detection means coupled to said memory means and to said date counting means for detecting coincidence between the desired date data stored in said memory means and the date data generated by said date counting means and for producing a coincidence signal during an alarm day on which both the desired date data and the generated date data coincide; and an alarm device coupled to said manually operable switch means and to said coincidence detection means for generating an alarm sound responsive to said coincidence signal and to operation of said manually operable switch means for turning on said lamp means to illuminate said display means, on said alarm day only.

5. An electronic timepiece according to claim 4, in which said alarm sound is a melody sound.

* * * * *

UNITED STATES PATENT AND TRADEMARK OFFICE

CERTIFICATE OF CORRECTION

PATENT NO. : 4,384,790

DATED : May 24, 1984

INVENTOR(S) : Eiji NAKAZAWA

It is certified that error appears in the above-identified patent and that said Letters Patent is hereby corrected as shown below:

On the initial page of the patent, change the title to read:

-- [54] ELECTRONIC TIMEPIECE HAVING AN ALARM UNIT--;

Column 1, before the first line of the patent, and under the number 1, change the heading to read:

-- ELECTRONIC TIMEPIECE HAVING AN ALARM UNIT--;

Column 2, line 29, change "flip-flop 16 the Q output" to read:

-- flip-flop 16. The Q output --.

Signed and Sealed this

*Twentieth* Day of *December 1983*

[SEAL]

*Attest:*

GERALD J. MOSSINGHOFF

*Attesting Officer*

*Commissioner of Patents and Trademarks*